US005755434A

United States Patent [19]

Takatoshi et al.

[11] Patent Number: 5,755,434

[45] Date of Patent: May 26, 1998

[54] DISPENSING HOPPER CONSTRUCTION FOR BANK NOTE PROCESSING MACHINE

[75] Inventors: Takemoto Takatoshi; Tsubota Khouichi, both of Tokyo; Kadomatsu Hideyuki, Odawara; Hamazato Ryouji, Kamakura, all of Japan

[73] Assignees: Kabushiki Kaisha Ace Denken; Kenmec Co., Ltd., both of Tokyo, Japan

[21] Appl. No.: 917,472

[22] PCT Filed: May 28, 1993

[86] PCT No.: PCT/JP93/00726

§ 371 Date: Mar. 15, 1995

§ 102(e) Date: Mar. 15, 1995

[87] PCT Pub. No.: WO93/24404

PCT Pub. Date: Dec. 9, 1993

Related U.S. Application Data

[63] Continuation of Ser. No. 338,527, Mar. 15, 1995, abandoned.

[30] Foreign Application Priority Data

Jun. 1, 1992 [JP] Japan ..... 4-140522
Jun. 1, 1992 [JP] Japan ..... 4-140529

[51] Int. Cl.[6] ..... B65H 5/22

[52] U.S. Cl. ..... 271/3.05; 271/113; 271/126

[58] Field of Search ..... 271/3.05, 3.03, 271/3.01, 3.04, 113, 157, 127

[56] References Cited

U.S. PATENT DOCUMENTS

| | | | |
|---|---|---|---|
| 3,741,535 | 6/1973 | Palkovic et al. | 271/113 |
| 4,549,661 | 10/1985 | Morishita et al. | 271/3.05 |
| 4,625,870 | 12/1986 | Nao et al. | 271/3.05 |
| 4,681,229 | 7/1987 | Uesaka et al. | 271/3.05 |
| 4,726,474 | 2/1988 | Arikawa et al. | 271/3.05 |
| 4,744,468 | 5/1988 | Goi et al. | 271/3.05 |
| 4,854,452 | 8/1989 | Uchida et al. | 271/3.05 |
| 4,863,038 | 9/1989 | Yoshikawa et al. | 271/3.05 |
| 4,957,285 | 9/1990 | Yamada | 271/3.05 |
| 5,499,805 | 3/1996 | Awma | 271/3.05 |

FOREIGN PATENT DOCUMENTS

| | | | |
|---|---|---|---|
| 1495860 | 9/1967 | France | 271/3.05 |
| 57-175631 | 10/1982 | Japan . | |
| 59-174989 | 10/1984 | Japan . | |
| 59-217536 | 12/1984 | Japan . | |
| 61-178335 | 8/1986 | Japan . | |
| 62-8930 | 1/1987 | Japan . | |
| 4197943 | 7/1992 | Japan | 271/113 |
| 2161145 | 1/1986 | United Kingdom | 271/3.05 |

*Primary Examiner*—Karen B. Merritt
*Assistant Examiner*—Douglas A. Hess
*Attorney, Agent, or Firm*—Armstrong, Westerman, Hattori, McLeland & Naughton

[57] ABSTRACT

A dispensing hopper construction for a bank note processing machine for effectively pooling a number of bank notes transferred from a bank note transferring section inside the bank note processing machine in order in a dispensing hopper section even while dispensing bank notes to the recipient side, as well as for effectively dispensing bank notes one-by-one based on a feed-out signal so that bank notes are not dispensed in a superposed or chained state. The bank note processing machine is constructed such that bank notes (1) are fed one-by-one from the bank note transferring section (A) into the dispensing hopper section (2) where bank notes are pooled so that they are fed out from the lower part thereof to the recipient side one-by-one. In this bank note processing machine, an introducing means (3) is mounted vertically movably at an upper portion of the dispensing hopper section (2) which is caused to communicate with the exit (a) of the bank note transferring section (A) at one end thereof so as to supporting receive a bank note (1) at the lower opposite sides thereof, and a pressing plate (4) for pressing down a bank note (1) at the lower opposite sides thereof, and a pressing plate (4) for pressing down a bank note (1) from above is mounted in such a manner as to vertically move above the introducing means (3), the pressing plate (4) being able to elastically pressed downwardly.

6 Claims, 8 Drawing Sheets

Fig. 11
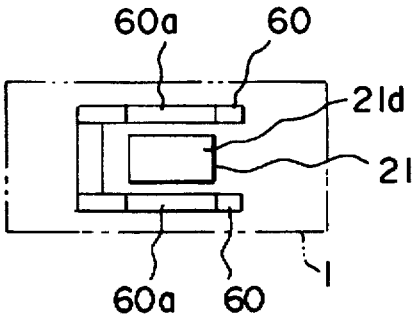
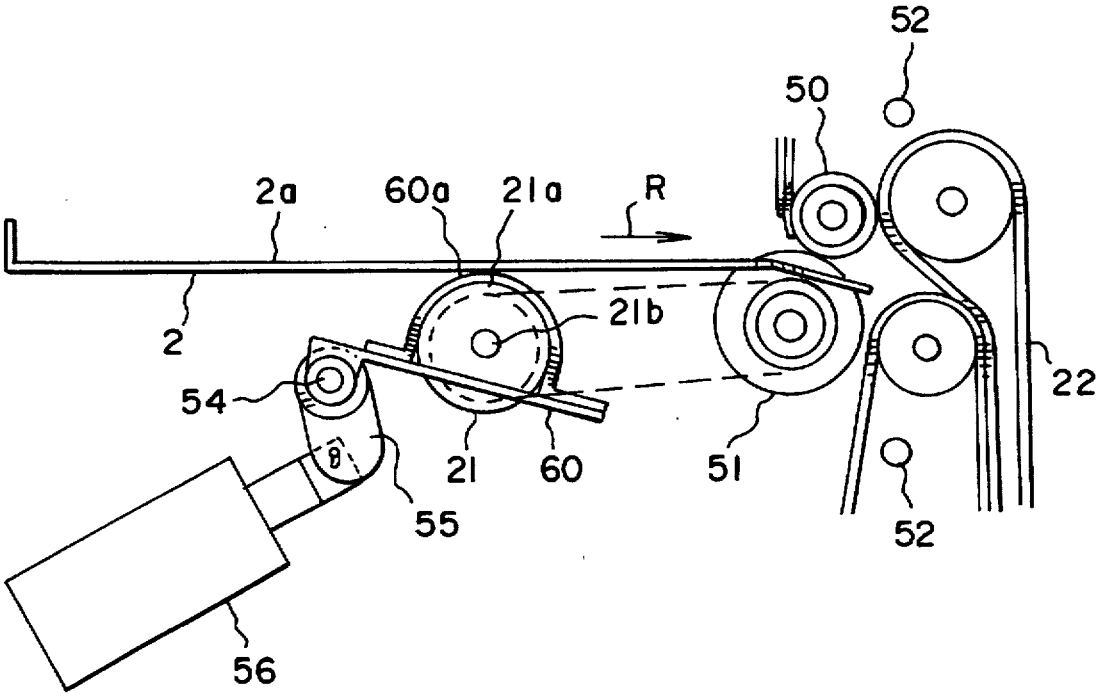
Fig. 12

DISPENSING HOPPER CONSTRUCTION FOR BANK NOTE PROCESSING MACHINE

This application is a continuation of Ser. No. 08/338,527 filed Mar. 15, 1995 now abandoned.

TECHNICAL FIELD

This invention relates to the structure of a dispensing hopper for a bank note processing machine, for example, a bank note changing machine, which is able to let out the stored bank note one-by-one to a dispensing side while storing the note.

BACKGROUND ART

There is a prior money processing machine which can apply bank notes one-by-one from a bank note transferring section to a dispensing hopper which is able to let out the stored notes one-by-one from the lowest note to the dispensing side. As shown in Japanese Patent Publication No. 4-4636, it is well known to the person skilled in the art to store bank notes, coming from a bank note transferring section, in a bank note storage section by catching them with guide boards mounted on an upper portion and a lower portion of the bank note storage section, and to transfer the notes between the guide boards one-by-one to the dispensing side after lowering the guide boards. And it is well known to dispense the bank notes stored in the bank note storage section by letting out the notes to the dispensing side with a letting-out roller under the bank note storage section and two note feeding rollers arranged in the dispensing side of the bank note storage section.

In such construction, however, it is impossible for the dispensing hopper to receive the bank notes from the bank note transferring section while the bank note is dispensing in the dispensing side. Furthermore, since the bank note storing capacity of the dispensing hopper is limited, the efficiency of processing the bank notes at the dispensing hopper is low. When the lowest bank note in the bank note storage section is let out by the letting-out roller, a next note will be let out immediately by the roller after the lowest note becomes out of contact with the roller; therefore, often two sheets of bank notes are let out, or many notes are let out in succession, and so the bank note processing machine makes it impossible to count the notes correctly and to dispense the notes.

DISCLOSURE OF THE INVENTION

To solve the above-mentioned problems, the present invention provides a structure of a dispensing hopper for a bank note processing machine which is devised for storing the bank notes efficiently in a bank note storage section and dispensing the notes stably and correctly to the dispensing side. The present invention has an introducing means which can support the edge of the underside of the bank note and a pressing plate which can force down the note. The introducing means is movable in a vertical direction above a dispensing hopper, and one end of the introducing means communicates with an outlet of a bank note transferring section. The pressing plate can move vertically within the introducing means and can be forced down. The vertical movement of the plate is done by a motor located above the introducing means. The outlet of the bank note transferring section can move vertically according to the vertical movement of the introducing means. A unit, equipped with the introducing means, and so forth, moves vertically, and the bank note storing capacity of a dispensing hopper is detectable by detecting the vertical movement of the unit with sensors. Alternatively, the unit may be only lifted and it may be placed on the bank notes in the dispensing hopper as a weight.

Furthermore, the present invention has a letting-out roller, positioned under a bottom of a dispensing hopper, whose upper portion projects above the bottom, and two rollers positioned in a vertical plane adjacent the dispensing side end of the hopper. The present invention also has stoppers, located near said letting-out roller, whose upper portions can be moved between one position above the upper portion of the letting-out roller and another position under the upper portion thereof. The upper portion of the stopper is formed as a circular arc similar to the upper portion of the letting-out roller. The stoppers are located on both sides of the letting-out roller to be able to contact with the surface of the bank note. The stoppers can pivot around their common pivot and can be moved vertically by a solenoid. An introducing means for receiving the bank notes from a bank note transferring section and a pressing plate, which can move vertically in the introducing means, are located above the dispensing hopper movably in a vertical direction.

Therefore, if the bank note is transferred from the outlet of the bank note transferring section into the introducing means, the pressing plate pushes down the note from the introducing means to the dispensing hopper, and the note is stored therein. Thus, the hopper can receive the notes in succession even though notes are being dispensed from the hopper to the dispensing side. Since the outlet of the bank note transferring section and the introducing means can be moved upward together, the dispensing hopper can receive the notes efficiently without being limited in its bank note storing capacity. The bank notes stored in the dispensing hopper are pressed by the unit as a weight and the force of the pressing plate thereby the notes can be dispensed efficiently one-by-one from the lower portion of the dispensing hopper.

When the stoppers are in the waiting position, the upper portions of the stoppers project above the letting-out roller; therefore the roller does not touch the under surface of the bank note, and the note is not let out from the hopper even when the letting-out roller rotates. If a letting-out signal is outputted, the stoppers move downward and the lowest bank note in the hopper can be sent to the dispensing side by the letting-out roller. As soon as the bank note becomes out of contact with the roller, the stoppers rise to push up the next note so that it does not touch the roller. Thus, two sheets of bank note are prevented from letting out at the same time, or many notes from being successively let out and the ordered number of notes can be dispensed efficiently by repeating the above-mentioned movement of the stoppers just the ordered number of times.

BRIEF DESCRIPTION OF THE DRAWINGS

FIG. 11 is a sectional plan view showing a part of FIG. 10.

FIG. 12 is a side view showing an operating state of FIG. 10.

BEST MODES FOR CARRYING OUT THE INVENTION

One embodiment of the present invention will be described with reference to the accompanying drawings.

Figure 3:
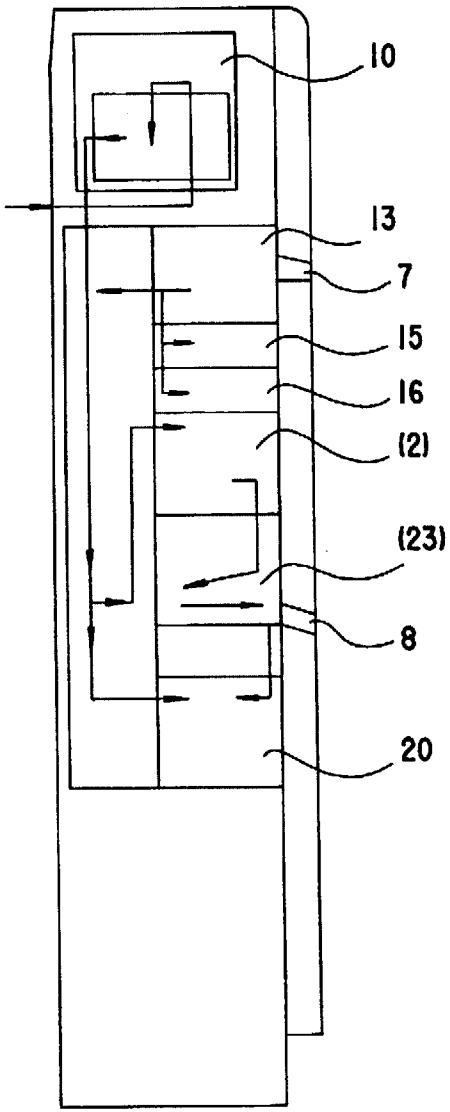
FIG. 3 is a schematic side view of the money changing machine.
Figure 2:
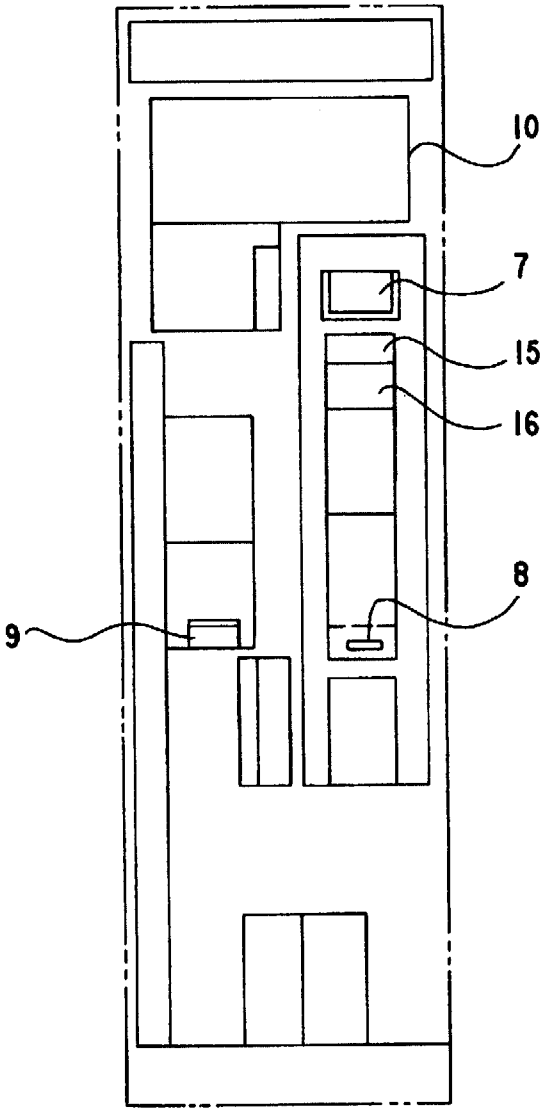
FIG. 2 is a schematic elevation of a money changing machine.
Figure 4:
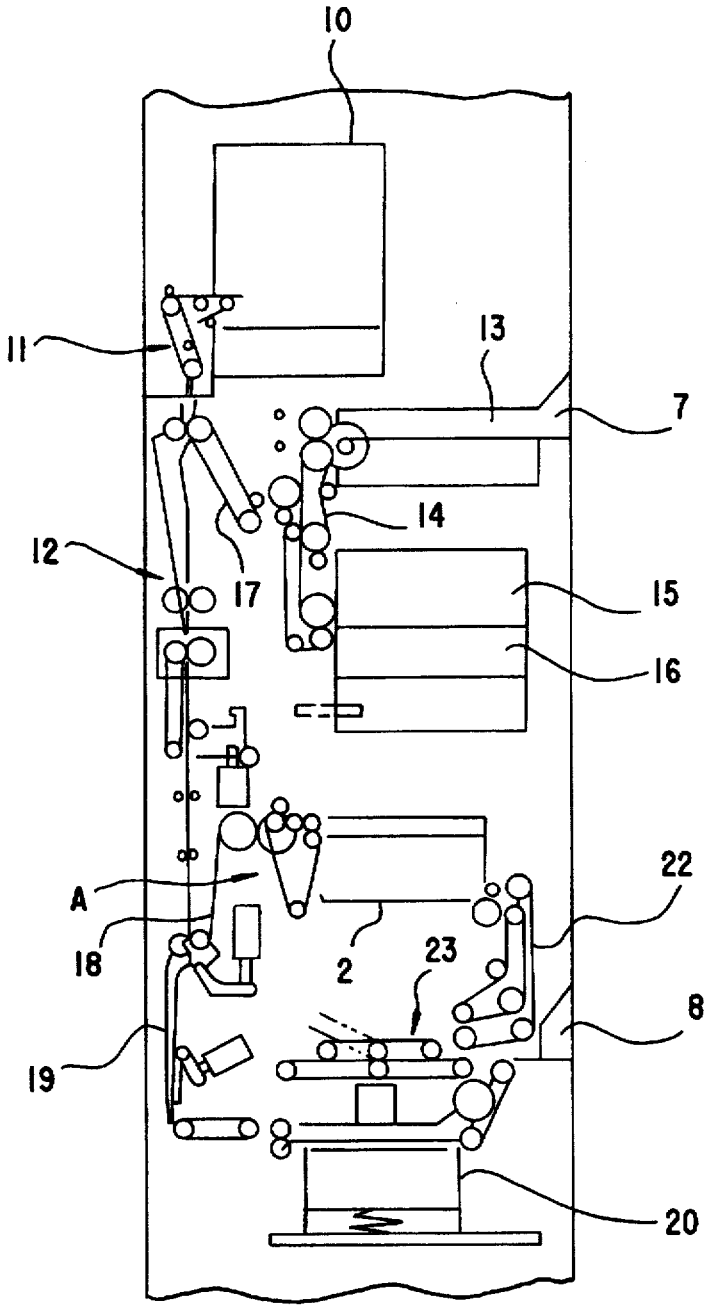
FIG. 4 is a schematic side view showing the inside of the money changing machine.

FIG. 2 and FIG. 3 show a bank note processing machine, a money changing machine, which is mounted in an island comprised of many game machines, such as pachinko game machines. As shown in FIGS. 2 to 5, a bank note inserting slot 7, a bank note eject 8 and a coin eject 9 are formed on the front of the bank note processing machine. The inside of the processing machine is equipped with many means; a 1,000-yen note stocker 10 which receives and stocks the 1,000-yen notes transferred from the inside of the island; a first transferring path 11 which can let out the 1,000-yen note one-by-one from said 1,000 yen note stocker 10; a second transferring path 12, connected to said first transferring path 11, which can smooth out crumpled notes and judge the front or back of the note in it; an identifying section 13 which is connected to said bank note inserting slot 7; a 10,000-yen note stock 15 and a 5,000-yen note stocker 16 which are connected to said identifying section 13 via a transferring path 14; a transferring path 17 which transfers only 1000-yen notes from said transferring path 14 to said second transferring path 12; a third transferring path 18, connected to a terminal of said second transferring path 12, which can make even the front of the note and transfer it; a fourth transferring path 19, connected to the terminal of said second transferring path 12, which can transfer the 1,000-yen note to the third transferring path 18 turning over the 1,000-yen note if the note is not made even the front, and a rejecting box 20, connected to the terminal of said fourth transferring path 19, which can receive damaged 1,000-yen notes.

A bank note transferring section A, connected to said third transferring path 18, which can let out the 1,000-yen note is also connected to a dispensing hopper 2. The 1,000 yen note is let out from a bottom 2a of said dispensing hopper 2 by a letting-out roller 21, and the note is transferred to intermediate storage section 23 by a belted transferring apparatus 22. If disagreement between the number of the note and the counted number of the note is not found by sensors, the note is dispensed from the bank note eject 8. If disagreement between the number of the note and the counted number of the note is found by sensors or double notes begin to be let out, the transfer of the note is stopped and transferred to the rejecting box 20 via a reject introducing plate 25. As shown in FIG. 3 by arrows, good state 1,000-yen notes, transferred from the inside of the game island or inserted to the bank note inserting slot 7, are made even at their front and sent to the bank note eject 8. But, on the other hand, bad condition notes or incorrectly counted notes are sent to the rejecting box 20.

A unit B is provided above said dispensing hopper 2 so as to be able to move vertically along a guide rod 26. An introducing means 3, made up of two parallel plates, which can support the edges of the underside of the note is mounted in the lower portion of the unit B. A pin 28 is fixed to a disk 27 which is rotated by a motor 5b. Frame 29 is fixed to the underside of the unit B. If the rotating pin 28 contacts with the lower edge of frame 29, the unit B is raised and, after the pin 28 moves toward the lower side, the position of the unit B is lowered by gravity. At the end of the unit B, which is in front of one end of said introducing means 3, two rollers 31, 32 are located up and down and they form an exit a of the bank note transferring section A. The two rollers are hung with a belt 30 of the bank note transferring section A. Guide rollers 33, 34 are located above the upper roller 31 so as to be able to face the belt 30. A pressing plate 4 is mounted so as to be able to move in the introducing means 3. Two supporting rods 35 are provided on the upper surface of the pressing plate 4, and each rod 35 is slidably inserted into two guides 36 provided on the upper portion of the introducing means 3. Upper ends of the guides 36 are coupled by a coupling plate 37. A movable body 39 moves vertically along a guide rod 38. The guide rod 38, between the movable body and the upper surface of said coupling plate 37, mounts a compression spring 40. A pin 42 of a rotating plate 41, rotated by a motor 5a, is inserted into said movable body 39. A detecting sensor 43a is located at the same height of the highest point of movement of the movable body 39 and a detecting sensor 43b is located at that of lowest point, the detecting sensors 43a, 43b detect the vertical movement of the movable body 39. The vertical movement of said unit B is detected by sensors 6a, 6b, and 6c.

Figure 1:
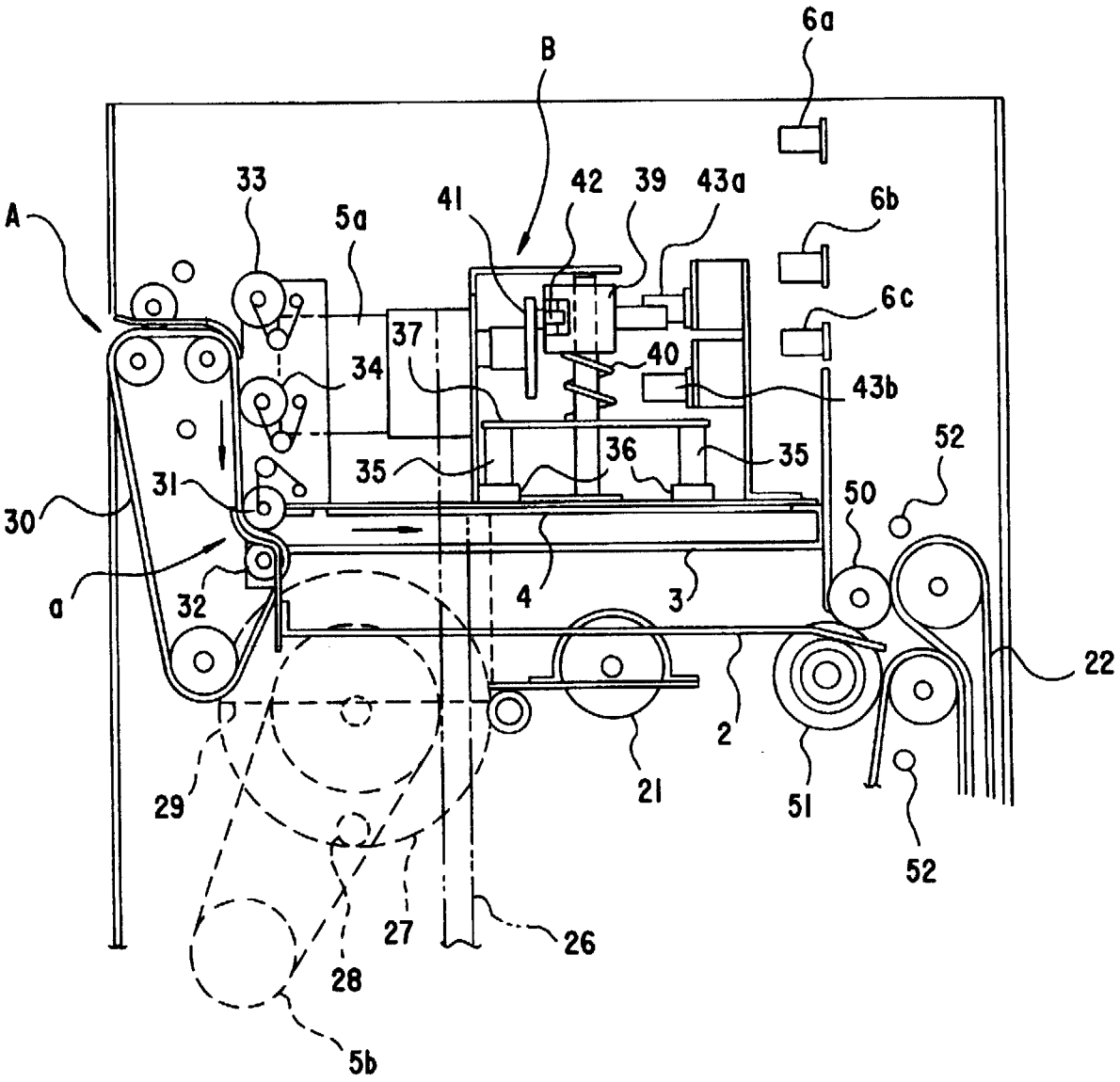
FIG. 1 is a schematic side view showing a principal part of one embodiment of the present invention.
Figure 7:
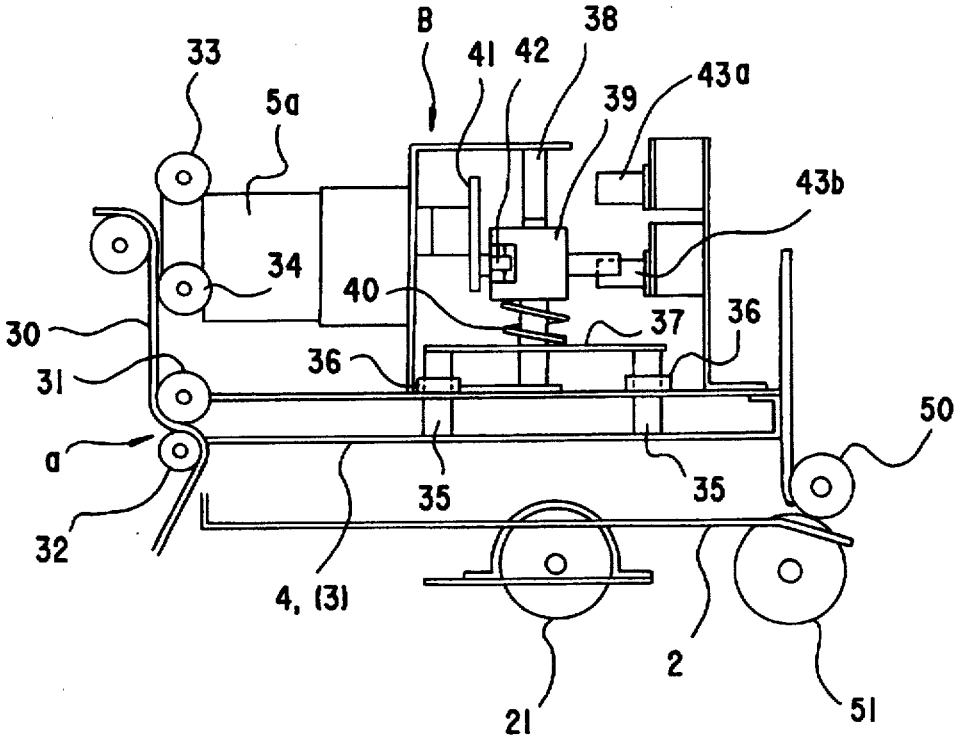
FIG. 7 is a side view showing an operating state of FIG. 1.
Figure 8:
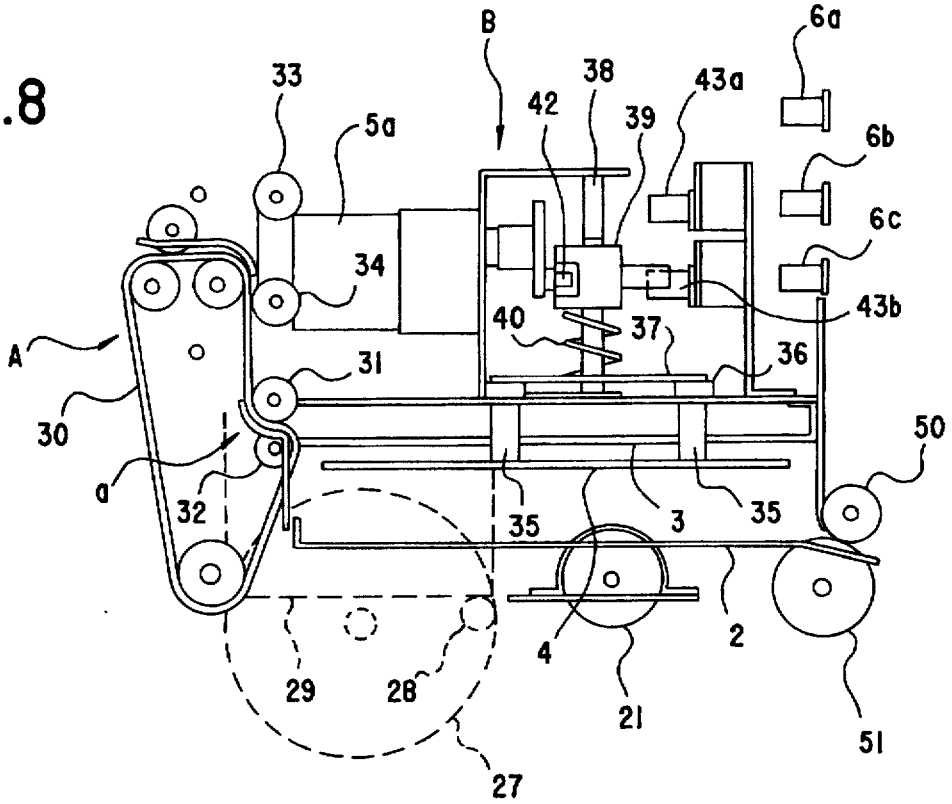
FIG. 8 is a side view showing another operating state of FIG. 7.
Figure 9:
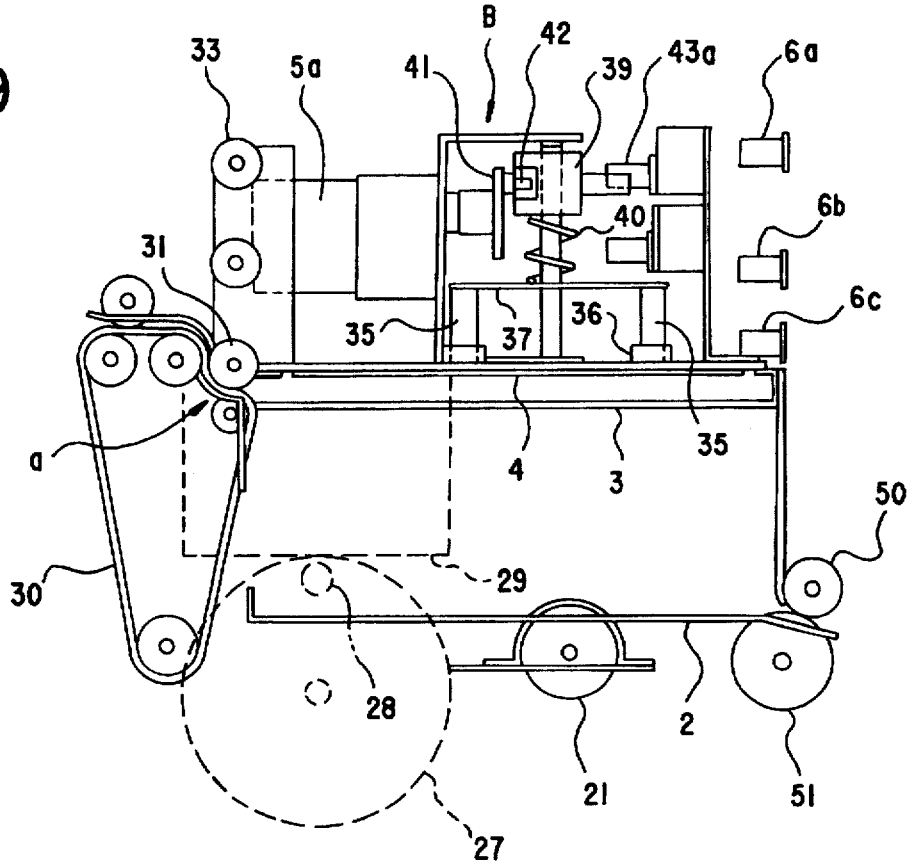
FIG. 9 is a side view showing another operating state of FIG. 8.

Therefore, as shown in FIG. 1 by arrows, the 1,000-yen note 1 transferred from the bank note transferring section A and let out from the exit a is set into the introducing means 3, and meanwhile, the bank note 1 stored in the dispensing hopper 2 is let out to the intermediate storage section 23 by letting-out roller 21 one-by-one from the lowest note by turns. When the motor 5a stops after a half rotation, the pressing plate 4 drops with the movable body 39 and pushes the note 1 on the introducing means 3 into the dispensing hopper 2 storing the notes as shown in FIG. 7. Then the motor 5b operates and the pin 28 raises the unit B, while, as shown in FIG. 8, the pressing plate 4, forced down to the notes in the dispensing hopper 2, is still pushed down thereto. Therefore, a difference in level occurs between the pressing plate 4 and the introducing means 3, and the note 1 is placed on the notes in the dispensing hopper. As shown in FIG. 9, when the unit B is raised to the highest point, motor 5b operates and the pressing plate 4 returns to an initial position, and, as shown in FIG. 1, the unit B is lowered to the bank notes in the dispensing hopper 2 by gravity. The unit B serves as a weight, and the notes are dispensed efficiently, one-by-one, from the lower portion of the dispensing hopper 2. The bank note storing capacity of the hopper 2 is measured by detecting the position at which the unit B waits during bank note dispensing.

Next, another aspect of the present invention which is equipped with stoppers 60, 60 on both sides of the letting-out roller 21 will be described.

In bottom 2a of said dispensing hopper 2, a rubber letting-out roller 21 is provided so that its upper portion 21a projects upwardly from the bottom 2a. Out of the dispensing side end of the dispensing hopper 2, note feeding rollers 50, 51 are provided close to the introducing side of the belted transferring apparatus 22. The letting-out roller 21 is linked with the note feeding roller 51 via a transmission means 53 which is operated by a main motor. First sensors 52 are mounted near the note feeding rollers 50, 51.

As shown in FIGS. 1, 11, and 12, adjacent both sides of said letting-out roller 21 are stoppers 60, 60 that are movable in a vertical direction by pivoting around a supporting point 54. The upper portions 60*a* of the stoppers 60 are formed like a circular arc similar to the upper portion 21*a* of the letting-out roller 21. The stoppers 60 are able to move without being impeded by an axis 21*b* of said letting-out roller 21. An arm 55, linked to said supporting point 54, is connected to a solenoid 56 which operates in accordance with a detecting signal from said first sensors 52. By the operation of the solenoid 56, the upper portions 60*a* of both stoppers 60 can be moved between a position higher than the upper portion 21*a* of the letting-out roller 21 and a position lower than that.

Figure 5:
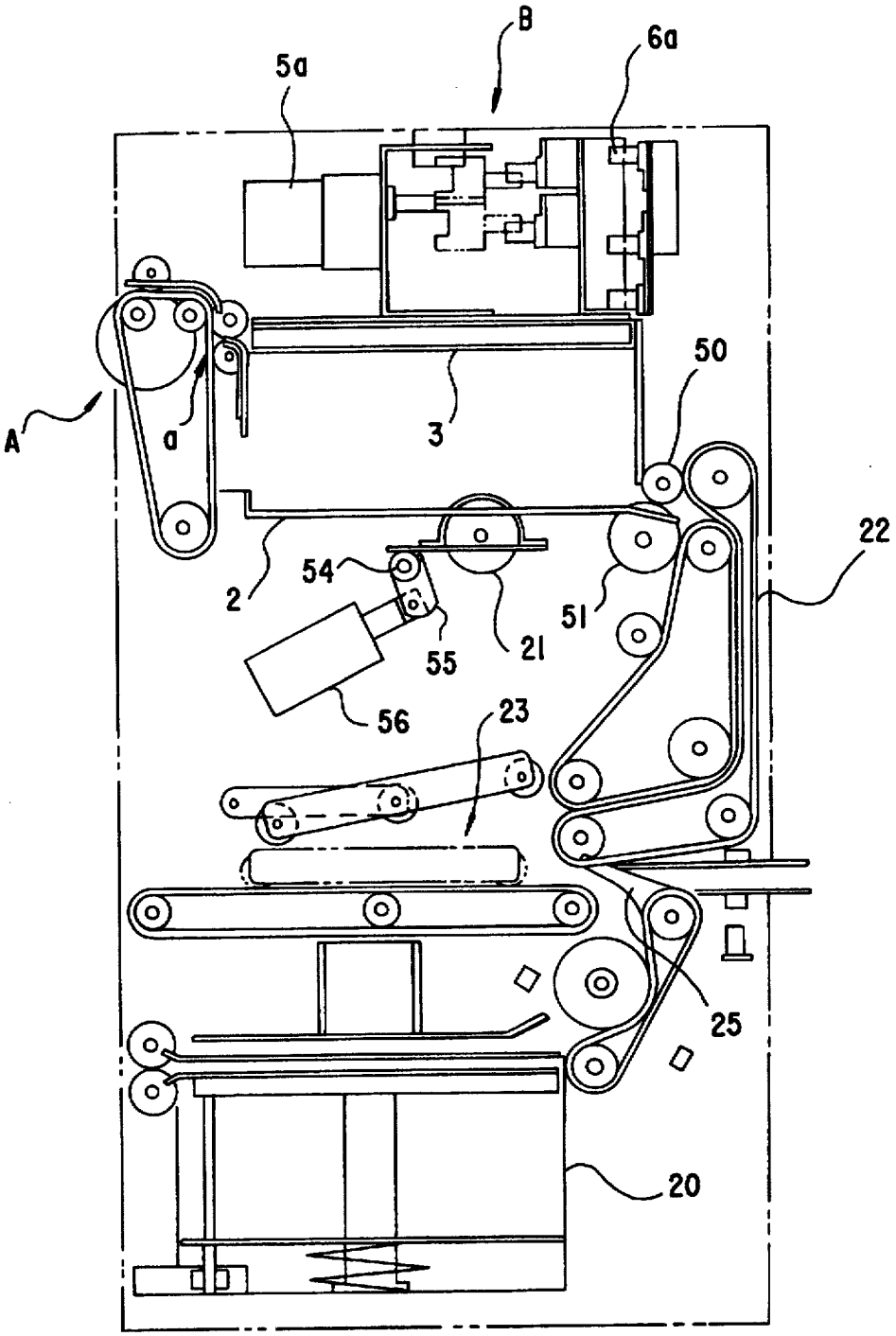
FIG. 5 is a partially enlarged side view of FIG. 4.
Figure 6:
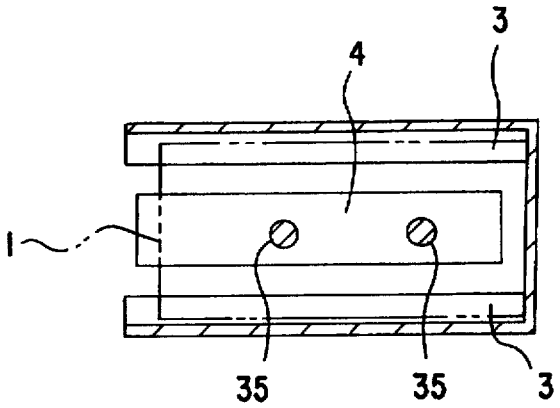
FIG. 6 is a sectional plan view showing a part of FIG. 1.
Figure 10:
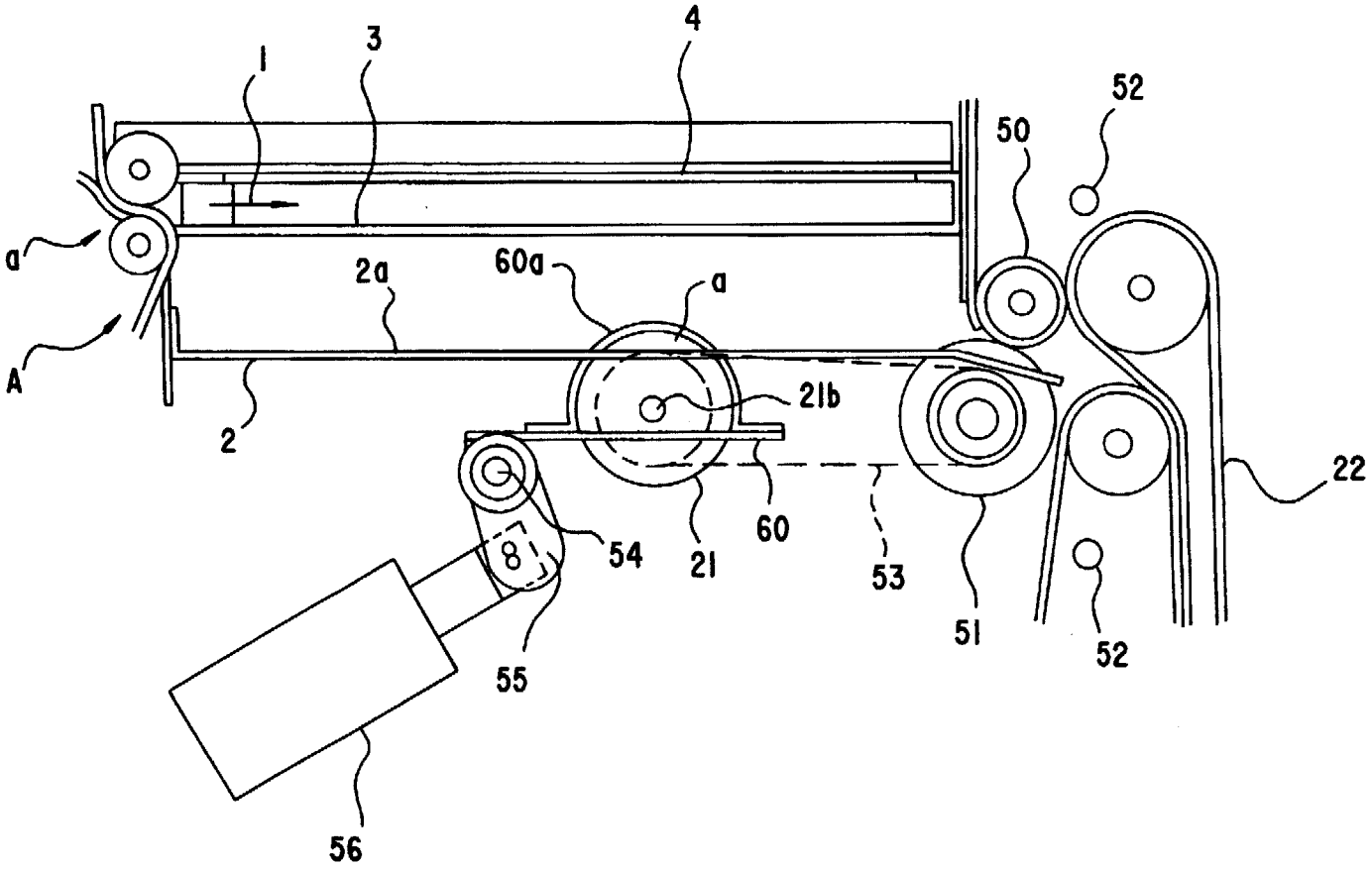
FIG. 10 is a schematic side view showing a principal part of another embodiment of the present invention.

Accordingly, the 1,000-yen note 1, as shown by an arrow, is transferred from the exit a of the bank note transferring section A to the introducing means 3. The pressing plate 4 moves downward to push down the note and unit B moves upward, and then the bank notes are stored one-by-one in the dispensing hopper 2. The unit B serves as a weight, and the notes are transferred and stored in the hopper 2 successively, whether the note 1 is dispensed from the dispensing hopper 2 or not. As shown in FIGS. 1, 5, and 10 the upper portions 60*a* of the stoppers 60, 60 can be positioned above the upper portion 21*a* of the letting-out roller 21 even if the letting-out roller 21 rotates when the note dispensing is stopped; therefore, the stoppers 60, 60 can wait with the note being supported by their upper portions 60*a* for preventing contact between the note 1 and the letting-out roller 21. If the transferring signal is output, the solenoid 56 operates to lower the stoppers 60, 60 as shown in FIG. 12, and the lowest bank note can be let out by the letting-out roller 21 in the direction indicated by an arrow R until the first sensor 52 detects the bank note 1. As soon as the note becomes out of contact with the letting-out roller 21, the stoppers 60, 60 rise to push up the next, succeeding bank note so that it may not touch the roller 21. Thus, two sheets of bank note are prevented from letting out at the same time, or many notes are prevented from successive letting out, and the ordered number of sheets of note can be dispensed efficiently by repeating the above-mentioned movement of the stoppers just the ordered number of times.

Industrial Applicability

According to the present invention, if the note 1 is transferred from the exit a of the bank note transferring section A into the introducing means 3, the note 1 is pushed down by lowering pressing plate 4 from the introducing means 3 to the dispensing hopper 2 and is stored therein; therefore, the note can be stored efficiently and successively in the hopper 2 even though a note 1 is dispensed from the dispensing hopper 2 to the dispensing side. Since the unit B, together with the outlet a of the bank note transferring section A and the introducing means 3, moves in the vertical direction, the dispensing hopper 2 can receive the note 1 efficiently without being limited in its bank note-storing capacity. Furthermore, the bank notes stored in the dispensing hopper 2 are pressed by the unit B, as a weight, and the force of the pressing plate; thereby the note can be dispensed efficiently one-by-one from the lower portion of the dispensing hopper 2. Thus, the bank note processing by the dispensing hopper 2, in a bank note processing machine, can be done accurately and efficiently.

From another point of view of the present invention, the dispensing hopper 2 can store efficiently bank notes 1 transferred from the bank note transferring section A. The upper portions 60*a* of the stoppers 60, being able to be positioned above the upper portion 21*a* of the letting-out roller 21, can wait supporting the note by their upper portions 60*a* for preventing contact between the note 1 and the letting-out roller 21, even if the letting-out roller 21 rotates when the note dispensing operation is stopped. If the transferring signal is output, the stoppers 60 lower, and the lowest bank note is let out by the letting-out roller 21; then, as soon as the note becomes out of contact with the letting-out roller 21, the stoppers 60 rise to push up the next, succeeding bank note so that it may not touch the roller 21. Thus, two sheets of bank note are prevented from letting out at the same time, or many notes from being successively let out, and the ordered number of sheets of note can be dispensed efficiently by repeating the above-mentioned movement of the stoppers just the ordered number of times. Therefore, the present invention improves the bank note dispensing performance of the dispensing hopper 2, though its structure is so simple.

We claim:

1. A bank note processing machine for processing bank notes from a bank note transferring section, comprising:

a dispensing hopper including a bottom for receiving bank notes passed to said dispensing hopper, a movable unit positioned above said dispensing hopper and being in substantially open communication therewith, said movable unit carrying an exit from said bank note transferring section, an introducing means movable with said movable unit and including a pair of mutually spaced bank note support plates operative to receive bank notes from said exit of said transferring section, a pressing plate carried by said movable unit and positioned for vertical movement between said bank note support plates for pressing a bank note supported on said support plates into said dispensing hopper, means for moving said pressing plate vertically with respect to said bank note support plates, and means for raising said movable unit and said presser plate with respect to said dispensing hopper after said pressing plate has pressed a bank note into said dispensing hopper, said raising means including means enabling said movable unit with said pressing plate raised therein to be returned by gravity downwardly into said dispensing hopper to provide weighted pressure on bank notes contained therein.

2. A bank note processing machine as claimed in claim 1 wherein said pressure plate moving means includes a motor mounted in said unit above said introducing means.

3. A bank note processing machine as claimed in claim 1 including:

a letting out roller having its upper portion projecting above said bottom of said dispensing hopper, a plurality of bank note feedings rollers positioned to receive bank notes let out of said dispensing hopper by said letting out roller, means for rotatably driving said letting out roller and said feeding rollers, a plurality of stoppers positioned with respect to said letting out roller within said dispensing hopper bottom, and means for moving said stoppers with respect to said letting out roller from a position above the upper portion thereof to a position below the upper portion thereof.

4. A bank note processing machine as claimed in claim 3 wherein said stoppers have upper portions formed as circular arcs similar in shape to that of said upper portion of said letting out roller.

5. A bank note processing machine as claimed in claim 3 wherein said stoppers are disposed adjacent both ends of said letting out roller.

6. A bank note processing machine as claimed in claim 3 including a supporting point for supporting said stoppers for pivotal movement, and a solenoid operative to pivot said stoppers about said supporting point between said positions above and below the upper portion of said letting out roller.

* * * * *